United States Patent [19]

Papajewski et al.

[11] Patent Number: 4,606,287

[45] Date of Patent: Aug. 19, 1986

[54] APPARATUS AND DEVICE FOR FOLDING-IN OR TUCKING-IN ENDS OF WAISTBANDS INTO A WAISTBAND, AND METHOD

[75] Inventors: Reinhold Papajewski, Friedrichstal; Gerd Rögner, Karlsruhe, both of Fed. Rep. of Germany

[73] Assignee: MSI Mechanische Systeme Industrienahautomaten Gesellschaft mit beschranker Haftung, Karlsruhe, Fed. Rep. of Germany

[21] Appl. No.: 624,595

[22] Filed: Jun. 26, 1984

[30] Foreign Application Priority Data

Jun. 30, 1983 [DE] Fed. Rep. of Germany ..... 3323541

[51] Int. Cl.[4] ..... D05B 21/00; D05B 35/08

[52] U.S. Cl. ..... 112/121.27; 112/147

[58] Field of Search ..... 112/121.27, 121.26, 112/147, 136, 137, 138, 2, 10, 152

[56] References Cited

U.S. PATENT DOCUMENTS

| | | | |
|---|---|---|---|
| 2,776,636 | 1/1957 | Seserman | 112/147 |
| 3,865,058 | 2/1975 | Rovin et al. | 112/10 X |
| 3,994,247 | 11/1976 | Cummins | 112/121.26 |
| 4,184,439 | 1/1980 | Schulz | 112/152 X |
| 4,280,421 | 7/1981 | Price | 112/147 |
| 4,389,957 | 6/1983 | Block et al. | 112/121.27 X |

FOREIGN PATENT DOCUMENTS

| | | |
|---|---|---|
| 2540928 | 4/1937 | Fed. Rep. of Germany . |
| 643226 | 3/1980 | Fed. Rep. of Germany . |

*Primary Examiner*—H. Hampton Hunter

*Attorney, Agent, or Firm*—Frishauf, Holtz, Goodman & Woodward

[57] ABSTRACT

To fold-in an end of a folded waistband (7) into the inside thereof, e.g. for a trouser or skirt, the upper (*7a*) and lower (*7b*) parts of the U-shaped waistband are seized by upper and lower gripping elements (5,9,18;6,10,19) such as paired fingers, or tongs, which are arranged in an upper and lower mechanical module (1,2). The ends of the folded upper (*7a*) and lower (*7b*) parts of the waistband are then opened, by spreading-apart of the gripping elements by relative movement of the modules 1,2, and the protruding terminal end portions of the waistband are folded into the inside of the waistband by sliders (12,13).

17 Claims, 9 Drawing Figures

APPARATUS AND DEVICE FOR FOLDING-IN OR TUCKING-IN ENDS OF WAISTBANDS INTO A WAISTBAND, AND METHOD

The invention relates to a device for in the protruding ends of a waistband which is attached to the upper edge of a garment part, for example, trousers, a skirt, or the like. The waistband is usually understood to be a U-shaped or folded band covering the edge of a trouser or a skirt from the inside and the outside. It is sewn on the rim or edge of the garment by a seam which locks the rim of the garment between the inside and the outside of the waistband.

BACKGROUND

The basic form of a waistband is U-shaped. The ends of the legs of the U are folded inside. One method of application is to fold an endless band to the required dimensions or to use two endless bands with rims folded toward the inside laid on top of each other with their folded rims, as well as the rim of the garment inbetween the bands. The bands, or a single folded band, is then sewn together by two seams, one along the upper edge of the waistband and one along the lower edge. In both production methods, the waistband ends protrude over the side edges of the garment part. The seams fastening the waistband to the garment part stop a certain distance before the side edge of the garment part. This permits folding the protruding waistband ends back into the waistband, such that the end of the waistband lays in a line with the side edge of the garment part. After this procedure, the waistband ends are sewn together in any suitable practical manner. A U-shape or L-shape bar tack may be used.

This folding of the ends of the waistband into the waistband is one of the few operations in the production of a skirt or a trouser which has to be performed by hand. This work demands a lot of dexterity and exactness from the operator, because the folded end of the waistband has to be exactly in one line with the side edge of the garment part. Wrinkles in the folded ends of the waistband can lead to local thickenings. For this reason, the folding in handling is not only a time-consuming method, but also very costly and difficult to automatize.

THE INVENTION

It is an object to provide an apparatus which permits automating the folding-in process of ends of waistbands, to provide a more uniform quality and high reliability. Briefly, a folding device is provided with two clamping elements, in which the upper and the lower part of the waistband edge can be inserted and clamped. The edge of the garment can be placed together with the upper part of the waistband end into the upper clamping element or with the lower part into the lower clamping element, or inbetween both elements. Both elements may diverge and so cause an opening of the waistband. The reference to upper and lower elements is for purposes of facilitating understanding of the invention and to associate the tools with respective parts of the waistband. The elements can be arranged not only one above the other, but in any other geometrical position, for example one beside the other. After opening of the waistband, the elements or additional elements, such as sliders, fold the ends of the waistband which protrude the clamping elements into the open waistband.

The depth of folding-in, or insertion, one set into the machine is then maintained.

DRAWINGS

Figure 1:
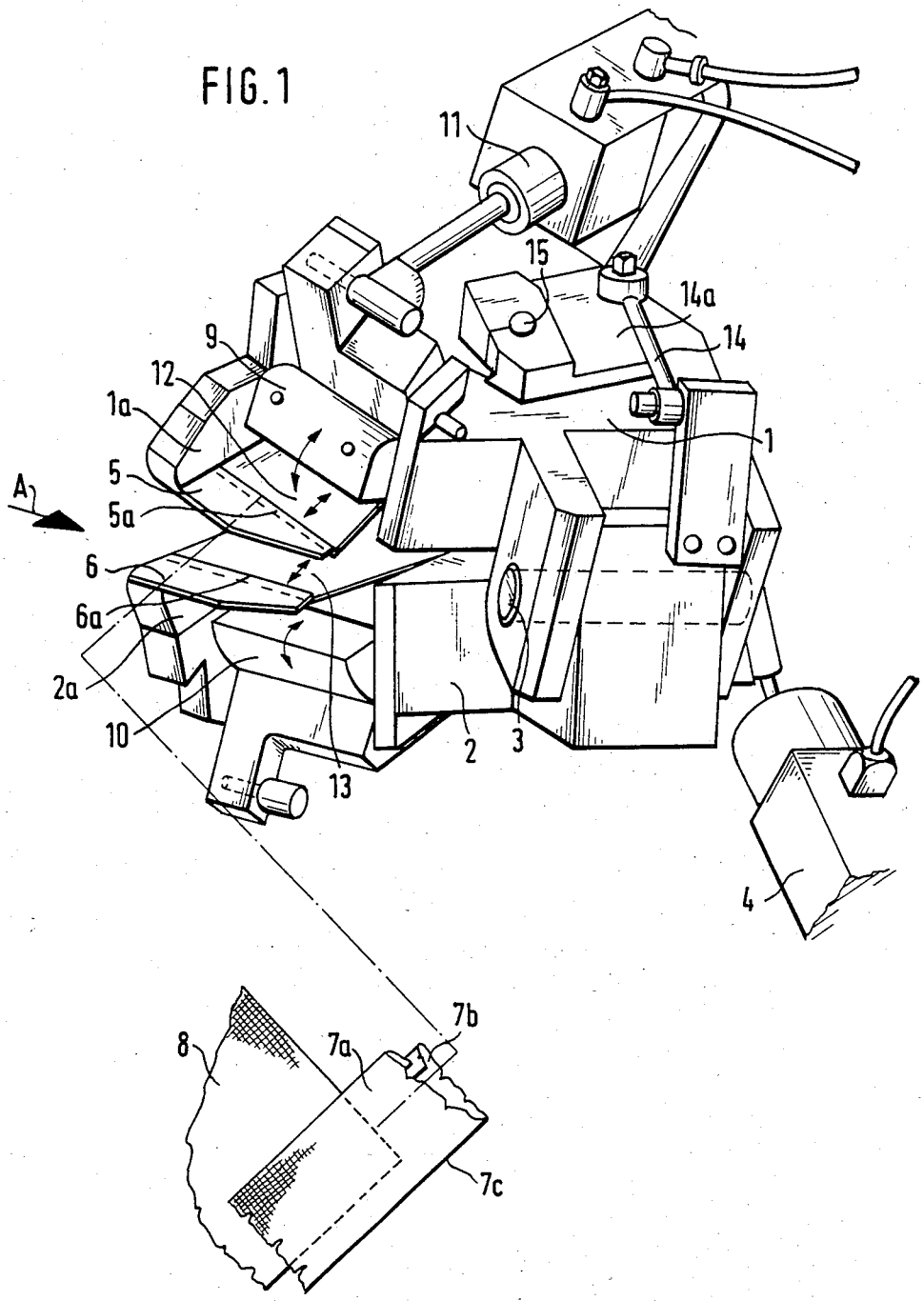
FIG. 1 is a perspective, partly exploded view on the whole device.

Referring to FIG. 1, the device is provided with separate tools for the clamping of the edges of the waistband and for subsequent folding. Basically, the device has an upper module 1 and a lower module 2, which are pivotably connected by a shaft 3 and swingable around said shaft. The shaft 3 is placed in the waistband plane and inclined to the longitudinal axis of the waistband. The opening and the closing of the modules is performed in the most simple arrangement by an air piston-cylinder device. Both modules open and close in a full cycle of the air-cylinder device. The movement can be performed by one module alone if the other module is kept stationary.

A finger 5 is arranged in the working area of the upper module 1, and is arranged in the working area of the lower module 2. The fingers 5,6 are placed in an inclined position with respect to the pivot shaft 3. The width of said fingers tapers towards their free ends to allow easy loading of the ends of the waistband.

The upper part *7a* of a waistband 7 will be placed above the upper finger 5; the lower part *7b* will be placed below the lower finger 6. In the loaded position, the longitudinal axis of the waistband is in a perpendicular position to the inner edges *5a* and *6a* of the fingers 5 and 6. The lateral position of the waistband on the fingers is determined by an adjustable stop element. A free distance is left between the end of the fingers 5,6 and the closed edge of the waistband *7c* to allow diverging of the fingers 5,6 and opening of the waistband. The ends of the fingers diverge during the opening process to give space for the folding-in of the ends of the waistband. The garment part 8 (for example a trouser) extends in opposite direction of arrow A, and its side eges is parallel to the edge *5a* of the finger 5.

The garment part 8 is sewn on to the inside of the upper part of the waistband *7a*. The garment part 8 thus will lay on top of the finger 5. If the garment part 8 is sewn to the lower part of the waistband *7b*, the garment part will be placed under the lower finger 6.

A clamping finger 9 is pivotably hinged on the upper module; a clamping finger 10 is pivotably hinged on the lower module 2. Both clamping fingers 9,10 are moveable relative to their modules and can be mechanically moved against their corresponding fingers 5 and 6, and can be pressed against the fingers 5,6 to fasten the loaded waistband. The clamping fingers are activated by air-cylinders. The pneumatic piston-cylinder aggregate 11 for the upper clamping finger 9 can be sewn in FIG. 1.

The upper module 1 has a slider 12 and the lower module 2 has a slider 13. Both sliders, as seen in FIG. 1, can be moved from their back-position towards the fingers 5,6 and into the free space between said fingers. Even so, the movement of the sliders is in the direction of the waistband, the upper slider 12, in addition, moves gradually from the top of the inside and the lower slider 13 moves gradually from the bottom to the inside. Both said sliders also perform a side movement relative to the fingers 5,6 which will be described in detail hereinbelow.

The sliders 12,13 are moved by air-cylinder aggregates. In the example described, the slider mechanism is driven by the relative movement of the two modules. FIG. 1 shows only the mechanism for the upper slider 12, which has a lever 14 which is pivotably connected to the module 2 and has a connection via additional elements, e.g. links, to the slider 12. This connection will be described later in FIG. 8.

OPERATION, WITH REFERENCE TO FIGS. 2–7

Figure 2:
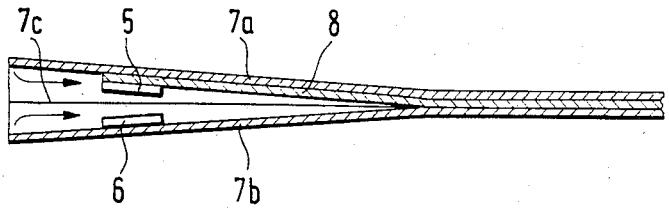
FIG. 2 is a view in the direction of arrow A which shows slighly open fingers, waistband layers, and the garment part.

FIG. 2 shows a view in the direction of arrow A. The view points in the direction from the garment part into the U-shaped waistband. The waistband end is open towards the observer. The right area is already sewn together with the garment part inbetween. To simplify the loading of the waistband, which will be moved against the direction of the arrow A onto the fingers 5,6, the fingers are set in a slightly open position, as shown in FIG. 2. The clamping fingers 9,10, for the loading process, are in open position and are not shown in FIG. 2 for reasons of simplicity.

Figure 3:
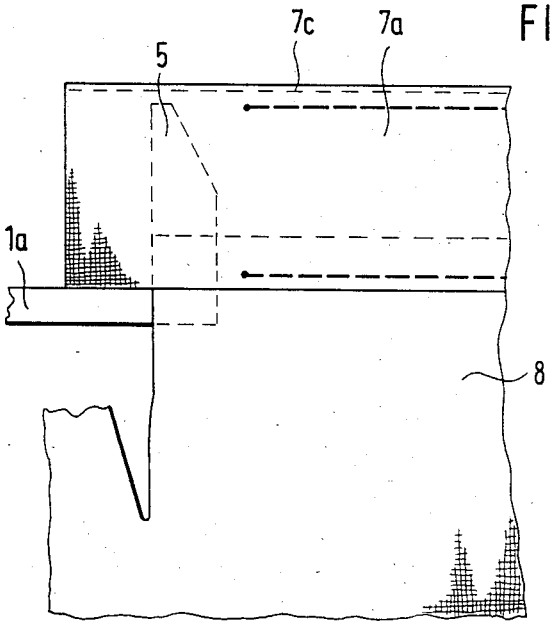
FIG. 3 is a vertical view on FIG. 2.

FIG. 3 shows the position of the waistband, relative to the fingers 5 and 6. When the waistband is loaded in the correct position, the clamping fingers 9,10 will be moved into the clamping position.

Figure 4:
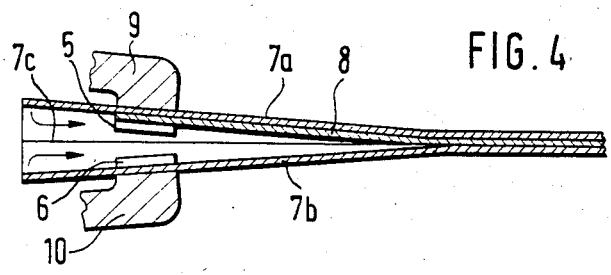
FIG. 4 is a view similar to FIG. 2 with clamping fingers and shown in clamping position.
Figure 5:
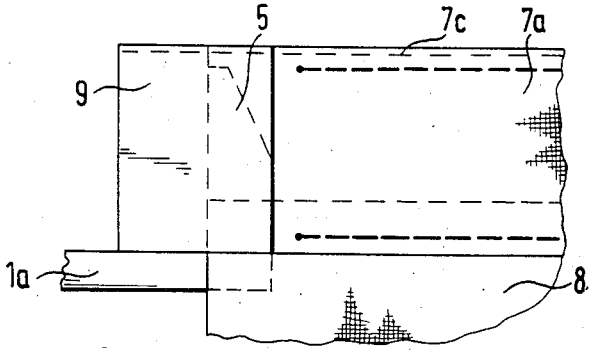
FIG. 5 is a view similar to FIG. 3 with a clamping finger shown in the clamping position.

FIG. 4 shows the upper part of the waistband end 7*a* and the garment part 8 clamped between the upper finger 5 and the upper clamping finger 9. The lower part of the waistband end 7*b* is clamped between the lower finger 6 and the lower clamping finger.

Figure 6:
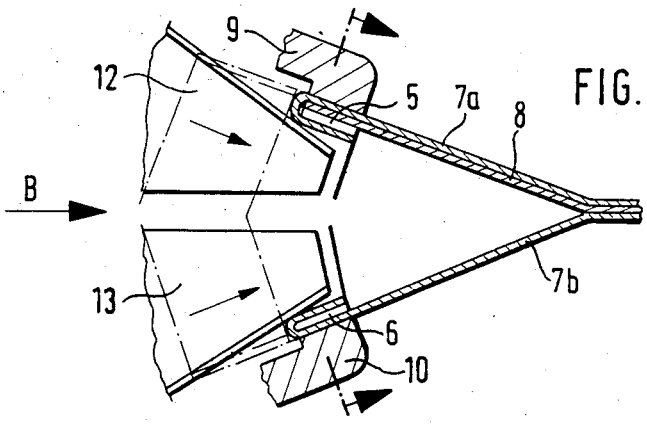
FIG. 6 is a view similar to FIG. 4 with the clamping fingers in an open position and folding sliders which are just folding the ends of the waistband into the open waistband.
Figure 7:
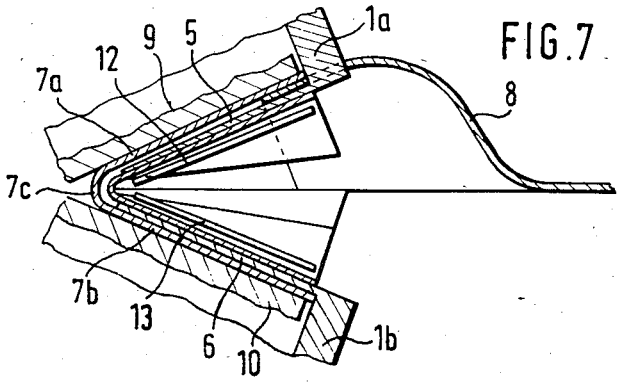
FIG. 7 is a sectional view on FIG. 6 in the direction of arrow B of FIG. 6.

In the following steps, both modules 1 and 2 are spread apart, as shown in FIGS. 6 and 7. Driven by this movement, both sliders 12 and 13 move towards the clamping tools. The upper slider 12 moves from its upper position on a slanted path to the inner side of the upper finger 5 and the lower slider 13 moves from its lower position on a slanted path to the inner side of the lower finger 6. These slanted paths of the sliders are advantageous because the slider tops contact the protruding waistband ends on their outer surfaces and bend the ends around the edges of the fingers 5*a* and 6*a* to the inside of the fingers 5 and 6, i.e. inside the waistband. The sliders are hinged in a manner that allows the tops of the sliders to move during the folding-in process on the slanted path (see FIG. 6) into a final position, where the slider plane is parallel to the plane of the fingers—see FIG. 7.

For a good handling of the protruding parts of the ends of the waistband, the tops of the sliders are pressed slightly against the fingers 5,6 after the sliders have been moved underneath the fingers. FIG. 6 also shows that when the modules 1,2 diverge, the fingers 5,6 do not open in parallel. The opening in the fastening area of the fingers is much bigger than the opening at the tops of the fingers. The fastening area is the area where the fingers are fastened to the carrying arms 1*a* and 2*a*. The described V-shape opening of the fingers is essential for the perfect folding-in of the waistband ends and is affected by the angled arrangement of the pivot shaft 3 relative to the fingers 5,6. This causes a wide opening of the free edges of the U-shaped waistband and a small opening in the area of the closed edge of the U-shaped waistband 7*c*. The v-shaped opening is shown in FIG. 7 which is a view in the direction of arrow of FIG. 6. The view direction is parallel to the waistband. It can be seen that the closed edge 7*c* of the waistband 7 is stretched to give enough space for the folding-in process. During this stretching, the closed edge 7*c* of the waistband 7 moves slightly to the inside of the waistband, which means, in FIG. 7, a slight movement toward the right. This guarantees that both sliders 12,13 perform the folding-in operation without producing any unwanted wrinkles or pleats. The sliders perform, during the folging movement, an additional lateral movement relative to the fingers, and towards the closed edge 7*c* of the waistband 7. The mechanism for this movement can be seen in FIG. 8.

Figure 8:
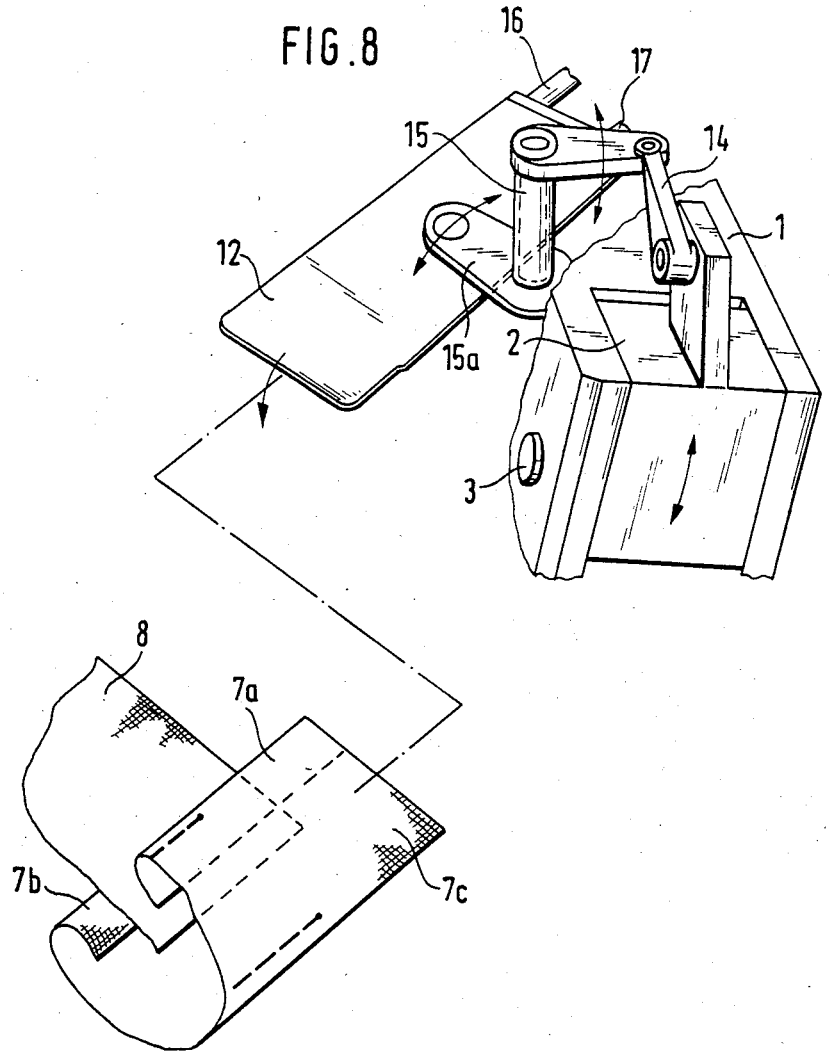
FIG. 8 shows a portion of the mechanism of FIG. 1.

FIG. 8 shows the slider control mechanism of the upper module without the carrying housing; the lower mechanism can be a mirror image thereof. It can be seen that the lever 14 pivoted on clamping plate 14*a* (FIG. 1) shown as link 8, moves the pivot shaft 15, which is pivotable around a vertical axis. The pivot shaft is pivoted in the upper module 30 (not shown in FIG. 1). The lever 15*a* of the pivot shaft 15 is pivotably connected with the slider 12. The slider 12 is loosely slideably guided by guide shafts 16 and 17 which are fixedly located in the module 1. Upon spreading the modules and resulting counter-clockwise rotation of the shaft 15, slider 12 is shifted forwardly and also slightly laterally displaced—see arrow 12*a* at the forward end of slider 12. The result is application of outward pressure on the edge 7*c* of the waistband and smoothing-out of any folds or creases in the ends 7*a*, 7*b* which may have formed.

Spreading apart, or diverging of the modules 1,2 results in a rotary movement of the pivot shaft 15, which again results in a sliding movement towards the clamped waistband end combined with a lateral movement of the slider. The type of the movement is indicated by the arrow at the top of the slider 12 in FIG. 8. At the end of the movement of the slider 12, the slider presses from the inner side of the waistband against edge 7*a* of the waistband, and thereby guarantees a wrinkle- and pleat-free folding.

Figure 9:
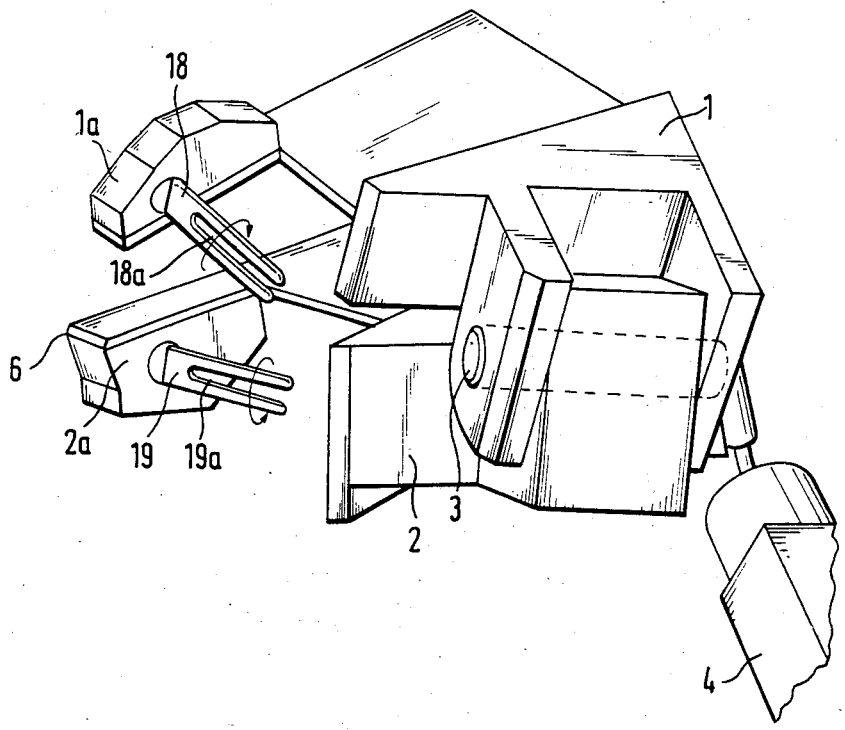
FIG. 9 is a view similar to FIG. 1 in which the folding and clamping fingers are replaced by grippers.

FIG. 9 shows a variation which uses only two gripping tools 18 and 19 for seizing the ends of the waistband and the following folding-in thereof. One gripping element, each replaces one finger 5,6, one clamping finger 9,10 and one slider 12,13 of the embodiment of FIG. 1.

Both gripping elements 18,19 have a slot 18*a*,19*a* have a slot. 18*a*, 19*a* in the middle to form tongs, or fork elements. The parts of the waistband are clamped into these slots. The garment part can also be clamped into one of these slots or can be left free between both gripping elements. To guarantee a proper holding of the waistband in the gripping elements, it is recommended to design the elements as elastic fingers into which the ends of the waistband can be squeezed. As an alternative, an arrangement of additional spring-loaded fingers or similar elements which allow simple loading and proper holding of the waistband, e.g. operative similar to spring-loaded clothes pins, may be used.

After the ends of the waistband ends have been loaded into the slots of the gripping elements, the modules 1 and 2 diverge for a small distance. Then both gripping elements are twisted about 180° or more in a direction such that the protruding waistband ends are folded to the inside of the waistband. The twisting movement, which can be automatic, or by an operator gripping twist, bulbous protruding from the side of the modules, not visible in FIG. 9, is shown by the rotation arrows. It can be useful to twist the gripping tools around more than 180° to guarantee a proper folding. After the waistband is pulled out of the machine, the additional fold which is caused by the additional twist disappears automatically. The twist or tilting axes of the gripping elements 18,19 are placed eccentrically and parallel relative to the slots 18*a*,19*a* of the gripping elements. This improves the folding-in process. The embodiment of FIG. 9 needs only few elements, but is not as versatile as the one of FIG. 1, i.e. it cannot be used for so many different garment and waistband dimensions. Both embodiments have in common that mechanical folding-in of the ends of the waistband can be accomplished. The pivotable connection of the modules 1,2 for diverging movement simplifies the loading and unloading of the ends of the waistband. It is easier to load and unload the ends of the waistband when the fingers are closer together, the fingers then diverging for the folding-in operation. Another possible embodiment of the invention is to arrange the tools in a stationary wide-open position.

The position of the folded waistband ends is determined by the folding edge of the clamping elements, which can be adjusted in a required position relative to the side edges of the garment. With the possibility of this adjustment, the ends of the folded waistband can be brought exactly in line with the side edge of the garment part. Adjustment can be made by sliding the elements relative to the module, and clamping in adjusted position by a clamping screw, or the like. The clamping tools require an adjustment to fit the type of trouser then in production only once.

After folding, the clamping elements 5 converge. Then the eventually applied folding elements move back into the starting position, leaving the folded ends of the waistband in the closed waistband. At the end of the operation, the clamping elements are pulled out of the waistband end and the garment part is pulled off the device. To prevent that the folded end of the waistband loses its shape, while being pulled out of the machine, the clamping tools may be pressed together for a short time after the folding operation is finished. This secures the fold of the waistband.

The folding device can also be used in a way that the final seams are sewn on the ends of the waistband while they are still in the folding device. In this case, an additional clamping and pressing operation is not necessary. Folding without wrinkles is most difficult in the inner, U-shape portion of the waistband. To guarantee a proper folding in this zone, it has proved advantageous to position pivotable elements, pivotable about an axis which is placed in the plane of the waistband and inclined with respect to the longitudinal axis of the waistband. This has the advantage that when the clamping elements, or fingers, open or spread, or diverge, the ends of the waistband open, with the result that a bigger opening of the U-shape open end will occur than at the inner end of the waistband U. Such an open position of the end of the waistband favors the folding-in of the protruding ends of the waistband toward the inner area of the waistband with a minimum of overall opening spread. As a matter of course, it is also possible to move both finger elements in the required relationship by similarly designed, but less economical mechanisms.

There are various possibilities of design fingers and clamping elements which seize and fold the ends of the waistband. Only two preferred embodiments have been described. In the embodiment of FIGS. 1–8, the fingers clamp the upper and lower ends of the waistband. The folding itself is performed by the upper and lower sliders arranged in a position to oppose the clamped-in ends of the waistband, which are clamped between the holding and the clamping fingers. During the folding process, after the end of the waistband is opened, the sliders move into the inner area of the waistband on a path which allows tp fold the protruding ends around the holding fingers into the inner portion of the waistband. By experience, it has proved useful to give the sliders a bi-directional movement in their movement plane or to move them in an inclined direction to the longitudinal axis of the waistband. By this movement, a better folding-in operation of the inner portion of the U-shape will be performed because the material is under better control in this most critical folding area, the inner portion of the U-shaped waistband. The operating elements, i.e. the clamping, holding and sliding elements, and their movements can be designed in different mechanical configurations. It has proved useful to design the upper holding and clamping fingers and the upper slider for the upper part of the waistband in the upper module, and to do the same with the lower fingers and slidrrs, for the lower part of the waistband, in the lower module. Thus designed, the movements of the elements of one module which are dependent of each other will be performed in the required sequence.

Opening for the loading of the waistband;
clamping of the waistband;
converging of both units and folding of the ends of the waistband by the sliders;
pressing together both units to provide for form stability of the fabric;
and opening of the clamping fingers to unload the waistband.

The embodiment of FIG. 9 has upper and lower gripping tongs, one tong or fork for the upper and one for the lower part of the waistband. The ends of the waistband are fitted or twisted around an axis parallel and close to the side edge of the garment to the inside of the waistband. In this case, the gripping tongs or forks not only perform the seizing and opening operation but also the folding-in of the ends of the waistband. In this design, a pair of gripping tongs or forks replace the holding and clamping fingers and sliding elements of the embodiment of FIGS. 1–8. By suitable pivoting of the axis of the gripping forks in relation to the edge of the garment, the required position of the folding edge of the waistband relative to the garment edge is guaranteed. The tilting axis should be parallel to the garment edge, but not in line with the garment edge. To simplify the loading of the ends of the waistband in the gripping forks and unloading of the waistband after the folding operation, the gripping elements have a longitudinal slot, in which the end of the waistband can be inserted. The slot usually clamps the waistband adequately for folding; additional clamping elements may be used to fasten the wristband in the gripping elements.

We claim:

1. Apparatus for folding-in protruding ends of a U-shaped waistband (7), in which the legs of the U form an upper part (7*a*) and a lowerpart (7*b*), said waistband being attached, in regions approaching the protruding ends, to a edge of the garment (8), such as a trouser or a skirt, in which the upper rim of the garment is sewn between the upper and lower parts (7*a*,7*b*) of the waistband, comprising a pair of holder modules (1,2), the modules of the pair being movable relative to each other between a spread-apart position and the closed, or adjacent position;

a pair of waistband holding elements (5,6,9,10; 18,19), each holding element being located on a respective module and each holding element being dimensioned and arranged to grip the end portions of a respective upper and lower part (7*a*,7*b*) of the waistband (7);

and means for moving the respective holding elements on the modules in the direction having a component transverse to the movement of the modules between said spread-apart and closed positions, to thereby fold the end protruding portions of the waistband back into the space defined between the legs of the U forming the upper and lower parts (7*a*) of the waistband.

2. Apparatus according to claim 1 wherein (FIG. 1) each of the holding elements comprises a pair of fingers (5,6;9,10) located in juxtaposed position, and movable between an open and a gripping position for gripping at least a portion of the protruding ends of the parts (7*a*,7*b*) of the waistband;

and a slider element (12,13) for pushing the protruding end portions of the respective parts of the waistband back into the adjacent portions of the waistband.

3. Apparatus according to claim 2 including an operating mechanism (14,15,15*a*,16,17) for moving the pairs of fingers and the slider, the sliders (12,13) moving laterally relative to the fingers (5,6,9,10), and in a direction towards the bend of the U (7*c*) of the waistband.

4. Apparatus according to claim 1 further including a pivot shaft (3) having a pivot axis pivotably retaining the modules, with respect to each other, the pivot axis being arranged in the plane of the waistband (7) and inclined with respect to the longitudinal axis of the waistband, and located at a distance from the bend of the U (7*c*) of the waistband.

5. Apparatus according to claim 3 further including a pivot shaft (3) having a pivot axis pivotably retaining the modules, with respect to each other, the pivot axis being arranged in the plane of the waistband (7) and inclined with respect to the longitudinal axis of the waistband, and located at a distance from the bend of the U (7*c*) of the waistband.

6. Apparatus according to claim 2 wherein a pair of fingers (5,6;9,10) is positioned, each, on the respective modue (1,2);

and a slider, each (12,13), is located adjacent the respective pairs of fingers on the respective module, the fingers of the pairs, and the sliders being conjointly operable for first seizing and clamping the upper and lower parts (7*a*,7*b*) of end portions of the waistband (7) and movement of the sliders (12,13) from a position opposite seized ends of the waistband for folding the terminal portions of the waistband into the inner area of the waistband on a part to fold the protruding ends of the parts of the waistband around the fingers and into the inner portion of the waistband.

7. Apparatus according to claim 5 wherein a pair of fingers (5,6;9,10) is positioned, each, on the respective module (1,2);

and a slider, each (12,13), is located adjacent the respective pairs of fingers on the respective module, the fingers on the pairs, and the sliders being conjointly operable for first seizing and clamping the upper and lower parts (7*a*,7*b*) of end portions of the waistband (7) and movement of the sliders (12,13) from a position opposite seized ends of the waistband for folding the terminal portions of the waistband into the inner area of the waistband on a part to fold the protruding ends of the parts of the waistband around the fingers and into the inner portion of the waistband.

8. Apparatus according to claim 1 wherein the waistband holding elements comprise an upper gripping elongated finger or tong (18) and a lower elongated finger or tong (19) for clamping, respectively, the upper part (7*a*) and the lower part (7*b*) of the waistband, and said fingers or tongs are tiltable about an axis parallel to their own longitudinal extent.

9. Apparatus according to claim 8 wherein the respective fingers or tongs (18,19) are rotatable within the respective module (1,2) and eccentrically positioned with respect to the longitudinal axis of the respective finger or tong.

10. Apparatus according to claim 9 wherein the fingers or tongs are formed, each, with a longitudinal slot (18*a*,19*a*) for gripping and clamping-in of the ends of the waistband parts (7*a*,7*b*).

11. Apparatus according to claim 10 wherein the fingers or tongs have elastic clamping elements (18,19;18*a*,19*a*) for elastically resiliently and reliably holding end portions of the respective parts (7*a*) of the waistband.

12. Apparatus according to claim 11 wherein the respective fingers or tongs (18,19) are rotatable within the respective module (1,2) and eccentrically positioned with respect to the longitudinal axis of the respective finger or tong.

13. Apparatus for folding-in protruding ends of a U-shaped waistband (7), in which the legs of the U form an upper part (7*a*) and a lower part (7*b*), said waistband being attached in regions approaching the ends, to the edge of a garment (8) such as a trouser or a skirt, in which the upper rim of the garment is sewn between the upper and lower parts (7*a*, 7*b*) of the waistband, comprising an upper waistband holding element (18);

a lower waistband holding element (19);

the holding elements, individually and separately gripping the respective end portions of the upper part (7*a*) and of the lower part (7*b*) of the waistband; and movable means (1, 2) engaging said holding elements and moving said holding elements for spreading-apart the upper and lower waistband holding elements with respect to each other to thereby spread apart and open the legs of the U, and for additionally moving said holding elements to fold the end portions of the upper and lower parts retained in said holding elements into the space of the spread-apart of the legs of the U of the waistband.

14. Apparatus for folding-in protruding ends of a U-shaped waistband (7), in which the legs of the U form an upper part (*7a*) and a lower part (*7b*), said waistband being attached, in regions approaching the ends, to the edge of a garment (8) such as a trouser or a skirt, in which the upper rim of the garment is sewn between the upper and lower parts (*7a, 7b*) of the waistband, comprising an upper waistband holding elements (5, 9);

a lower waistband holding element (6, 10), the holding elements individually and separately gripping, respectively, the end portions of the upper part (*7a*) and of the lower part (*7b*) of the waistband;

movable means (1,2) engagable with said upper and lower waistband holding elements (5, 9; 6, 10) for spreading the upper and lower waistband holding elements with respect to each other to thereby spread apart and open the legs of the U of the waistband;

and insertion elements (12, 13) engagable with the end portions of the waistband to fold-in the end portions of the upper and lower parts, respectively, into the spread apart legs of the U of the waistband, said insertion elements being coupled to and movable by said movable means (1,2).

15. Apparatus according to claim 14 wherein said insertion elements comprise sliders.

16. Apparatus according to claim 13 wherein one of the holding elements is positioned and dimensioned to also grip an edge portion of the garment (8) and hold said edge portion of the garment together with the end portion of the upper and lower parts into the open U of the waistband.

17. Apparatus according to claim 14 wherein one of the holding elements is positioned and dimensioned to also grip an edge portion of the garment (8) and hold said edge portion of the garment together with the end portion of the upper and lower parts into the open U of the waistband.

* * * * *

UNITED STATES PATENT AND TRADEMARK OFFICE

CERTIFICATE OF CORRECTION

PATENT NO. : 4,606,287

DATED : August 19, 1986

INVENTOR(S) : Reinhold PAPAJEWSKI

It is certified that error appears in the above-identified patent and that said Letters Patent is hereby corrected as shown below:

Column 7, line 27, should read: -- tions, to thereby fold the protruding end portions -- line 29, "weeh" should be -- ween --

Signed and Sealed this

Twenty-third Day of December, 1986

*Attest:*

DONALD J. QUIGG

*Attesting Officer* *Commissioner of Patents and Trademarks*